US005934937A

United States Patent [19]

McCarthy

[11] Patent Number: 5,934,937

[45] Date of Patent: Aug. 10, 1999

[54] COAXIAL CABLE CONNECTOR AND METHOD

[75] Inventor: Dale C. McCarthy, Pensacola, Fla.

[73] Assignee: Centerpin Technology, Inc., Gulf Breeze, Fla.

[21] Appl. No.: 08/980,784

[22] Filed: Dec. 1, 1997

Related U.S. Application Data

[63] Continuation of application No. 08/647,735, May 15, 1996, Pat. No. 5,775,934.

[51] Int. Cl.[6] ..... H01R 9/05

[52] U.S. Cl. ..... 439/583; 439/427

[58] Field of Search ..... 439/427, 428, 439/429, 578–583

[56] References Cited

U.S. PATENT DOCUMENTS

| | | | |
|---|---|---|---|
| 3,317,883 | 5/1967 | Gourley et al. . | |
| 3,444,507 | 5/1969 | Gerhard . | |
| 3,708,781 | 1/1973 | Trompeter | 174/75 C |
| 3,792,419 | 2/1974 | Spinner | 174/75 C |
| 3,860,320 | 1/1975 | Danner . | |
| 3,951,503 | 4/1976 | Caulkins . | |
| 4,013,333 | 3/1977 | Chang . | |
| 4,091,233 | 5/1978 | Berman | 174/88 R |
| 4,352,240 | 10/1982 | Komada . | |
| 4,786,760 | 11/1988 | Friedhelm . | |
| 5,052,946 | 10/1991 | Homolka . | |
| 5,403,201 | 4/1995 | McCarthy . | |

*Primary Examiner*—Lincoln Donovan
*Attorney, Agent, or Firm*—William M. Hobby, III

[57] ABSTRACT

An electrical connector for coupling to a coaxial cable. The connector has a housing with a bore therein and a first electrical conductive prong protruding axially into the housing bore for receiving the end of an insulated electrical conductor. A second electrical conductive prong is attached to the housing and protrudes axially into the housing bore generally concentric to the first electrical conductive prong. The coaxial cable end is pushed into the housing bore to drive the center conductor into the first conductive prong and the second conductive prong into the cable conductive sheath. A coaxial cable collar is shaped to fit over the end of a piece of coaxial cable placed in the housing and has compressible fingers for driving onto the coax cable outer insulation to lock the cable to the housing. A cap having an annular wedging surface therein compresses the coaxial cable collar in the housing onto the insulated coaxial cable.

16 Claims, 1 Drawing Sheet

COAXIAL CABLE CONNECTOR AND METHOD

This Application is a Continuation of my prior patent application, Ser. No. 08/647,735, filed: May 15, 1996 now U.S. Pat. No. 5,775,934 for Coaxial Cable Connector.

BACKGROUND OF THE INVENTION

The present invention relates to electrical connectors and a method of coupling an insulated electrical coaxial cable or wire without stripping the end of the insulated coaxial cable.

In the past, a wide variety of electrical wire connectors have been provided for connecting to wire ends. In a typical connector, the end of the wire is stripped of insulation and the bare wire is inserted into a connector where it can be soldered or clamped or otherwise attached to the connector. It is also common to tin the wire ends by coating the wire end with solder and a wide variety of connectors have been provided which removably hold the wire to the connector.

Typical connectors are seen in audio systems, such as in hi-fi speakers in which a wire end is stripped of the insulation and is inserted in an opening and a threaded nut is threaded down onto the wire, the nut can be loosened for removing the wire. Other audio speakers include spring clamps which allows a wire end to be stripped of insulation and inserted into an opening while lifting the spring connector clamp and then releasing the spring connector clamp onto the wire. Relifting of the spring connector clamp allows the removal of the wire end. Other commonly used connectors allow a stripped wire end to be inserted into a connector or into both ends of a connector and then clamped with pliers to collapse a conductive sleeve onto the wire. This type of connector can be insulated or not as desired since it is made of a malleable metal in which collapsing the conductive sleeve onto the stripped wire end provides the necessary electrical contact.

In contrast to these various types of wire connectors, the present invention deals with a wire connector that does not require the insulation to be stripped and also provides, in some embodiments, for the insertion of the insulated wire end in a manner to lock the wire end in place inside the bore of a wire connector.

Prior wire connectors can be seen in the following U.S. Patents. The Chang patent, U.S. Pat. No. 4,013,333, for a wire connector having two concentric sockets adapted to be assembled one into the other and in which the inner socket has a conductive needle mounted therein for sliding a wire end into each end of the connector and which also uses a spike pressed in two holes in the sleeves to penetrate the coating of the wire ends. In the U.S. Pat. No. to Danner, 3,860,320, a dangler cathode cable assembly is connected to a ball-like cathode member by stripping the end portion of the cable and inserting the end portion into a sleeve which is pressed into an undersized tapered socket and which has a pointed pin therein. In the U.S. Pat. No. to Friedhelm, 4,786,760, a cable connector for piezoelectric cable has an insulated cable end which is inserted into a sleeve. In the U.S. Pat. No. to Berman, 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector. In my prior U.S. Pat. No. 5,403,201 an electrical connector is coupled to an insulated electrical conductor without stripping the end of the insulated conductor. The insulated wire is held with a spring clamp which allows the wire to be released.

Other prior connector can be seen in Homolka U.S. Pat. No. 5,052,946 for a plug connector for a high voltage coaxial cable which uses a plug in contact for the connection with the central conductor. In the Komada U.S. Pat. No. 4,352,240 a method of connecting a coaxial cable to an electrical connector is provided which drives a pin shaped positive terminal into the center conductor. The S. Gerhard U.S. Pat. No. 3,444,507 is for an electrical connector for semi-solid conductors and the Caulkins U.S. Pat. No. 3,951,503 is a cable splice assembly for multiconductor cables; the W. C. Gourley et al U.S. Pat. No. 3,317,883 is for a high voltage wire coupling having a pair of prongs for coupling to the center conductor of insulated wires.

In my prior patent application I utilized an electrical connector for coupling to an insulated electrical coaxial cable end in which the coaxial cable is inserted into a bore in the connector housing to drive a prong into the cable end. The cable is then releasably clamped through the insulated cable with conductive clamps which extend into the conductive sheath to thereby form a conductive coupling to the center conductor and separately to the concentric conductive sheaf or braiding. The present application further provides an improved electrical contact for the concentric braiding of the coaxial cable and simplified clamping of the cable to the connector.

SUMMARY OF THE INVENTION

An electrical connector for coupling to a coaxial cable of the type having an inner conductor enclosed in an inner concentric insulation and having a generally concentric conductive braid of sheath therearound and an outer insulation enclosing the conductive braid. The housing has an electrically conductive portion and a bore therein and a first electrical conductive prong attached to the housing and protruding axially into the housing bore for receiving the end of an insulated electrical conductor. A second electrical conductive prong having a hollow cylindrical shape is attached to the housing and protrudes axially into the housing bore generally concentric to the first electrical conductive prong. The second cylindrical prong has an angled cutting edge on the end thereof. A coaxial cable collar is shaped to fit over a piece of coaxial cable placed in the housing and has compressible fittings sized for driving onto the insulated wire outer insulation. A housing cap member is attachable to the housing and shaped for the end of a coaxial cable to be slid therethrough. The cap has an angled surface therein to compress the coaxial cable collar fingers onto the insulated coaxial cable when the cap is attached to the housing over the collar to form a conductive path between the wire conductive braid and the electrically conductive housing portion when a coaxial cable is attached to the electrical connector by sliding the end of a coaxial cable end portion into the electrical connector housing bore and attaching the cap member over the collar.

A method of coupling an electrical connector to the end of a piece of coaxial cable includes the steps of selecting a connector having a housing having an electrically conductive portion and a bore therein and a first electrical conductive prong attached to the housing and protruding axially into the housing bore for receiving the end of an insulated electrical conductor. A second electrical conductive prong is attached to the housing and protrudes axially into said housing bore generally concentric and around the first electrical conductive prong. The second prong has an angled blade on the protruding end thereof.

A coaxial cable collar shaped to fit over a piece of coaxial cable is selected and has compressible fingers portion sized for compressing onto the insulated wire outer insulation. A housing cap member is selected which is attachable to the housing and shaped for the end of a coaxial cable to be slid therethrough and is slid over the end of a piece of coaxial cable. The selected coaxial cable collar is slid over the end of a piece of coaxial cable. The selected housing cap is attached to the selected housing to compress the coaxial cable collar onto the insulated coaxial cable so that the coaxial cable is attached to the electrical connector with a conductive path formed between the coaxial cable conductive braid and the electrically conductive housing portion.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
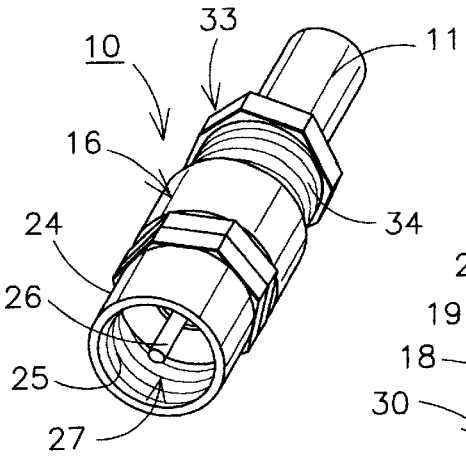
FIG. 1 is a perspective view of a coaxial cable connector in accordance with the present invention.
Figure 2:
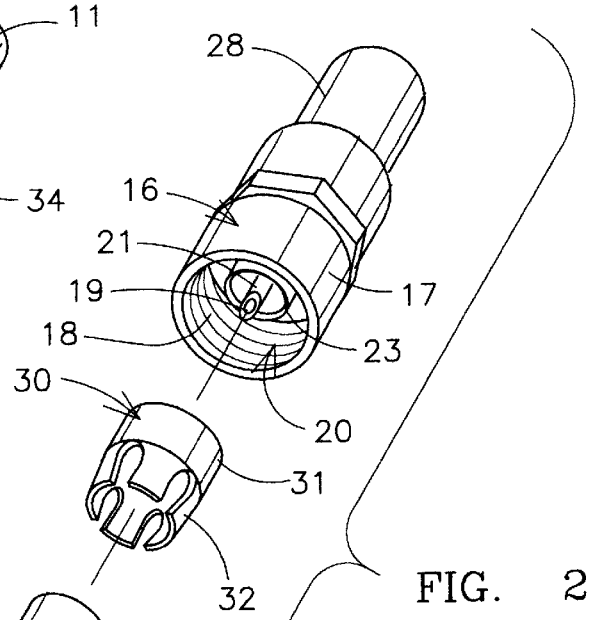
FIG. 2 is an exploded view of an electrical connector and a portion of a coaxial cable in accordance with the present invention.

FIGS. 1–4 of the drawings illustrate an electrical connector 10 for a coaxial cable end 11. The coaxial cable 11 has a center conductor 12, concentric insulation 13, a concentric conductive wire braid or sheath 14 around the insulation 13 and an outer insulation layer 15 covering the conductive sheath 14. The connector 10 connects various types and sizes of coaxial cable to a variety of plugs, jacks, and connectors, all referred to herein as an electrical connector. Connection to the connector 10 is without solder and without stripping the insulation from the cable. The coaxial cable 11 may be connected to an electrical apparatus, such as a television set, and requires that the center conductor 12 be electrically couplellto another conductor and that the outer sheath 14 be connected separately but insulated from the center conductor 12. The connector 10 has a connector housing 16 having a generally cylindrical cable attaching portion 17 having internal threads 18 and an internal bore 20. A connector prong or pin 21 extends axially into the bore 20 and is mounted to (and through) electrical insulation 29. An annular hollow cylindrical prong 23 extends from the base 22 concentrically around the prong 21.

The connector 10 may have a second housing portion 24 having internal threads 25 and a center connecting prong 26 extending axially into the bore 27. A second coaxial end 28 can be inserted into the bore 27 for contact against the center prong 26 from the opposite end of the housing 16.

A gripping collar 30 is illustrated having a generally cylindrical portion 31 and a plurality of resilient gripping fingers 32 extending from a cylindrical portion 31 at a slight inward angle from the cylindrical portion 31. A locking cap 33 has external threads 34 thereon and a wrench head 35. The locking cap 33 has a bore 36 extending therethrough. The coaxial cable 11 end is passed through the locking cap 33 and the gripping collar 30 is slid over the end of the coaxial cable 11. The coaxial cable then is slid into the bore 20 of the connector 10 and pushed against the prong 21 which enters the coaxial cable in the center portion thereof and into or against the center conductor 12. As the coaxial cable 11 is pushed further into the bore 20, the annular prong 23 having a sharpened edge 36 is driven directly into the coaxial cable sheath braid 14 under the insulation 15 to make electrical contact with the sheathing 14. The locking cap 33 can then be slid into the bore 20 driving the collar 30 into the bore where the external threads 34 of the collar 33 engage the internal threads 18 of the connector. The threaded locking cap 33 is tightened until the connector body 16 drives the locking collar 30 gripping fingers 32 against the annular angled surface 37 (FIG. 4) and forces the angled gripping fingers 32 into the outer insulation 15 of the coaxial cable end 11 to lock the cable in position in the connector. The center prong 21 may also be a hollow cylindrical prong having an angled tip 19 which allows it to penetrate into the end of the coaxial cable. The angled point allows for a better connection with the center conductor 12 of the coaxial cable.

The connector of FIGS. 1–4 can be made of any materials desired but it is anticipated that both the connector body 16 and the locking cap 33 can be made of a conductive metal, such as brass. The prongs 21 and 23 can be made of an electrical conductive material spaced from each other with an electrical insulating material 29. The gripping collar 30 can be made of any material desired, such as plastic or brass.

In operation, the tip of the coaxial cable 11 does not have any of the insulation stripped from the conductors as is normally required to connect a coaxial cable to a connector. The coaxial cable 11 has the cap 33 slid thereover followed by sliding the gripping collar 30 thereover. The coaxial cable 11 is then inserted into the bore 20 and pushed against the annular pointed prong 21 to drive the prong into the center conductor 12. It is further pushed into the bore 20 to drive the second annular prong 23 into the end of the coaxial cable 11 and into the electrical conducting sheath 14. The locking cap 33 is then slid into position to engage the threads 34 with the threads 18 of the bore 20 where the cap 33 is threaded into the connector body 16, driving the locking collar 30 against the base 22 and driving the angled gripping fingers 32 against the coaxial cable 11 to grip the coaxial cable. The tighter the cap 33 is threaded into the connector body 16, the greater the collar 30 grips the coaxial cable to prevent the coaxial cable from being pulled from the connector. Pulling on the coaxial cable 11 continuously increases the grip as the cable attempts to pull the gripping finger 32 against the cap 33.

Figure 5:
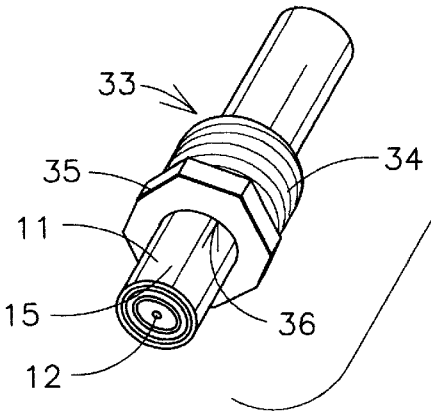
FIG. 5 is a sectional view of an alternative embodiment of the electrical connector.
Figure 5:
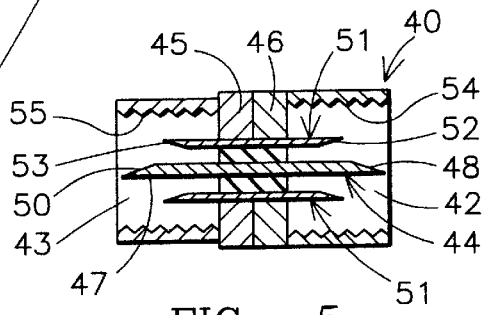
Figure 3:
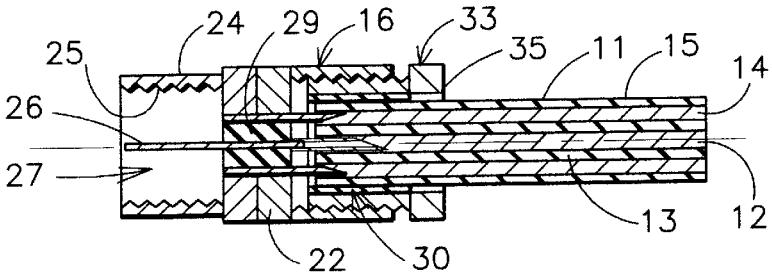
FIG. 3 is a sectional view of the electrical connector having a coaxial cable end attached thereto.
Figure 4:
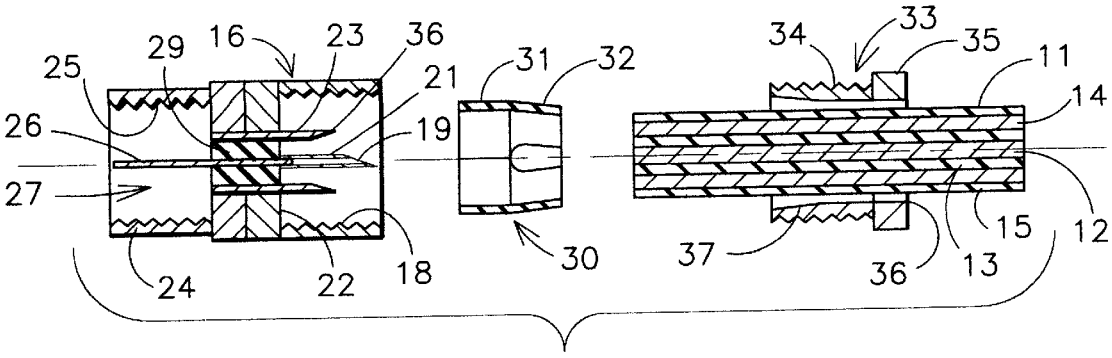
FIG. 4 is a sectional exploded view of the electrical connector of FIGS. 1, 2 and 3.

Turning to FIG. 5, an alternate embodiment of an electrical connector 40 is illustrated having a housing 41 having a first bore 42 in one end thereof and a second bore 43 extending into the other end thereof. A center pin prong 44 extends into the bore 42 and extends through a pair of base portions 45 and 46 of the housing and has a second portion 47 extending into the bore 43. The prong 44 may be a hollow cylindrical prong member having an angled end 48 on the prong end extending into the bore 42 and an angled cutting edge 50 on the opposite end of the prong 44 in the bore 43. An annular connector prong 51 also extends through the base members 45 and 46 and extend into the bores 42 and 43. An angled cutting edge 52 is on the edge of the annular prong 51 extending into the bore 42 while a similar cutting edge 53 is on the end of prong 51 extends into the bore 43. The prong 51, as can be seen, is concentrically mounted relative to the axis of the connector 40 and to the prong 44. The bore 42 has internal threads 54 therein while the bore 43 has internal threads 55 therein for attaching the cap members 33 over the collars 30, as shown in FIG. 4. The connector 40 allows one coaxial cable end to be inserted in the bore 42 and a second coaxial cable end to be inserted into the bore 43 for coupling the two coaxial cables together while simultaneously coupling the metal sheathing of each coaxial cable with the prong 51 as well as the center conductor of each coaxial cable through the prong 44. The cables can be connected together with the insulation of the cable still in place and without having to remove a portion of the cable insulation in order to extend the center conductor and to wrap the sheathing to make contact with a connector.

It should be clear at this time that an electrical connector for a coaxial cable has been provided which advantageously allows the coaxial cable to be attached to the connector without stripping or removing any of the insulation on the end of the cable to give a complete electrical connection to the center conductor and the conductive grounding sheath. However, the present invention is not to be considered as limited to the forms shown which are to be considered illustrative rather than restrictive.

I claim:

1. An electrical connector for coupling to a coaxial cable of the type having an inner conductor enclosed with an inner insulation and a concentric conductive sheaf around said inner insulation, said conductive sheaf being enclosed in an outer insulation comprising:

a housing having an electrically conductive portion and a bore therein;

a first electrical conductive prong having two end portions and being attached to said housing and having one end portion protruding axially into said housing bore for receiving the end of an insulated electrical conductor, said first electrical conductive prong having a bore extending thereinto;

a second electrical conductive prong having a generally cylindrical shape and having two end portions, said second electrical conductive prong being attached to said housing and having one end portion protruding axially into said housing bore generally concentric to said first electrical conductive prong and having an annular blade on the end thereof;

a coaxial cable collar shaped to fit over a piece of coaxial cable placed in said housing, said coaxial cable collar having a compressible portion sized for driving onto said insulated wire outer insulation, said compressible portion including a plurality of tapered compressible fingers supported on an annular ring;

a housing cap member attachable to said housing and shaped to receive the end of a piece of coaxial cable therethrough and to compress said coaxial cable collar plurality of compressible fingers in said housing onto said insulated coaxial cable when said cap is attached to said housing whereby a conductive path is formed between a coaxial cable conductive sheath and the second electrically conductive prong when a coaxial cable is attached to an electrical connector by sliding the end of a piece of coaxial cable into the electrical connector housing bore and attaching the cap member.

2. An electrical connector for coupling to an electrical conductor in accordance with claim 1 in which said first conductive prong has a generally hollow cylindrical shape having an angled tip.

3. An electrical connector for coupling to an electrical conductor in accordance with claim 1 in which said compressible collar has a tapered portion thereon compressible onto said coaxial cable outer insulation when said cap is driven thereagainst.

4. An electrical connector for coupling to an electrical conductor in accordance with claim 3 in which said cap member is threaded for threaded attachment to said housing.

5. An electrical connector for coupling to an electrical conductor in accordance with claim 4 in which said cap member has a generally cylindrical portion having external threads and said housing has a generally cylindrical portion having internal threads whereby said cap member can be threaded into said threaded housing portion.

6. An electrical connector for coupling to an electrical conductor in accordance with claim 1 in which said cap member has an internal annular wedge portion formed therein for driving said compressible collar onto said insulated wire outer insulation when said tapered portion is driven against said annular wedge portion of said compressible collar.

7. An electrical connector for coupling to an electrical conductor in accordance with claim 1 in which said housing has a second bore therein and said first electrically conductive prong is attached through said housing and into said second bore to form a center prong in said second bore.

8. An electrical connector for coupling to an electrical conductor in accordance with claim 8 in which said housing has two bores and said second electrically conductive prong extends into said housing second bore.

9. An electrical connector for coupling to an electrical conductor in accordance with claim 1 in which said housing has a center wall portion between the first and second bores for attaching said first and second prongs therethrough.

10. An electrical connector for coupling to an electrical conductor in accordance with claim 1 in which said housing has a threaded portion for threadedly attaching said electrical connector to a second connector.

11. An electrical connector for coupling to an electrical conductor in accordance with claim 10 in which said housing center wall has an insulating portion having said first prong attached therethrough, said insulating portion being attached to the inside of said second conductive prong.

12. An electrical connector for coupling to an electrical conductor in accordance with claim 7 in which said housing has a generally cylindrical shape.

13. An electrical connector for coupling to an electrical conductor in accordance with claim 12 in which said first and second conductive prongs are metal prongs.

14. A method of coupling an electrical connector to a coaxial cable of the type having an inner conductor enclosed with an inner insulation and a concentric conductive sheaf around said inner insulation said conductive sheaf being enclosed in an outer insulation comprising the steps of:

selecting a connector having a housing having an electrically conductive portion and a bore therein and a first electrical conductive prong attached to said housing through an insulated plate and protruding axially into said housing bore for receiving the end of a coaxial cable, said first electrical conductive prong having a bore extending thereinto and a second electrical conductive prong, said second electrical conductive prong being attached to said housing protruding axially into said housing bore generally concentric to said first electrical conductive prong and having an annular cutting edge on the protruding end thereof;

selecting a coaxial cable collar shaped to fit over a piece of coaxial cable and having a compressible portion sized for compressing onto said insulated wire outer insulation;

selecting a housing cap member attachable to said housing and shaped for the end of a coaxial cable to be slid therethrough;

sliding said selected housing cap over the end of a piece of coaxial cable;

sliding said selected coaxial cable collar over the end of said piece of coaxial cable; and attaching said selected housing cap to said selected housing to compress said coaxial cable collar in said housing onto said insulated coaxial cable whereby a coaxial cable is attached to an electrical connector with a conductive path formed between the coaxial cable conductive sheath and the electrically conductive housing portion.

15. The method of coupling an electrical connector to the end of a piece of coaxial cable in accordance with claim 14 in which said selected collar is a generally cylindrical hollow collar having tapered resilient fingers compressible onto the coaxial cable.

16. The method of coupling an electrical connector to the end of a piece of coaxial cable in accordance with claim 15 in which said selected housing has two bores and each said electrically conductive prong extends into each said housing bore.

* * * * *